US006164796A

United States Patent [19]

La Chiusa

[11] Patent Number: 6,164,796

[45] Date of Patent: Dec. 26, 2000

[54] CENTERPIECE STATION

[76] Inventor: Arturo A. La Chiusa, 435 Sherie Ct., Beaumont, Calif. 92223

[21] Appl. No.: 09/207,065

[22] Filed: Dec. 7, 1998

[51] Int. Cl.[7] ..... F21S 6/00

[52] U.S. Cl. ..... 362/122; 362/186; 362/190; 362/208; 362/251

[58] Field of Search ..... 362/442, 122, 362/431, 156, 101, 186, 190, 208, 184, 251

[56] References Cited

U.S. PATENT DOCUMENTS 2,565,980 8/1951 Moore ..... 177/329

4,926,786 5/1990 White ..... 116/50

5,489,887 2/1996 Porras ..... 340/332

*Primary Examiner*—Sandra O'Shea

*Assistant Examiner*—Bertrand Zeade

[57] ABSTRACT

A signaling device for restaurant tables and the like that obviates the need of hand raising or calling out for service having a base (10) housing a set of batteries (36) and a switch (44) which is connected to a flashing light bulb (24) secured into a socket (22) mounted at the upper end (30) of a pipe (14) which is fastened to the base at the lower threaded end (12). Turning switch (44) ON will cause bulb (24) to flash signaling the need for service; turning the switch OFF means that the service has been provided. The improvement may include accessories (52, 54, 56) to obviate the need for additional table space.

8 Claims, 8 Drawing Sheets

CENTERPIECE STATION

BACKGROUND—FIELD OF INVENTION

This invention has for its object the provision of signaling means, specifically as a method of calling for service from a table, such as in restaurants or the like.

BACKGROUND—DESCRIPTION OF PRIOR ART

Up to the present, the common way to call a waiter or a waitress for service has generally been in the manner of raising a hand or calling out. Such a manner represents an inconvenience and a waste of time until the call is perceived, thus slowing the process of serving food and beverages. This greatly reduces the availability of tables, and consequently creates a long waiting period for other customers in line who may decide to leave, rather than wait.

OBJECTS AND ADVANTAGES

Accordingly, besides the objects and advantages of the signaling means and method of calling for service described in my above patent, several objects and advantages of the present invention are:

(a) to provide a signaling device and method for better and more efficient service;

(b) to provide a signaling device that enables the waiter or the waitress to quickly spot from a distance the table in need of service considerably reducing the customer's waiting time, thus expediting tables availability and therefore increasing the volume of food and beverages sales;

(c) to provide the customer with a convenient signaling device to call for service while at the same time alerting the establishment's manager on how promptly the serving personnel responds.

(d) to provide a signaling device having a battery operated flashing bulb connected to a switch whereby the customer can turn said bulb ON by using said switch as a method to call for service and the waiter or waitress can use said switch to turn said bulb OFF as a method of response to said call.

Further objects and advantages are to provide a signaling device which obviates the need of hand raising or calling out for service, which is portable, which is simple to use, which can function as a centerpiece of multiple purposes and can be easily placed on a table without taking extra space by including a hand rotatable container to hold sugar, nutrasweet envelopes and other food seasonings, a napkins holder and two formed circular recesses in its base for positioning salt and pepper dispensers. Still further objects and advantages will become apparent from a consideration of the ensuing description and drawings.

DRAWINGS FIGURES

In the drawings, closely related figures have the same number but different alphabetical suffixes.

REFERENCE NUMERALS IN DRAWINGS

| | |
|---|---|
| 10 circular base | 12 pipe lower threaded end |
| 14 pipe | 16 battery holder |
| 18 base external palnut | 20 base internal locknut |
| 22 brass socket | 24 bulb |
| 26 positive alloy contact | 28 plastic pipe hole bushing |
| 30 pipe upper threaded end | 32 positive wire |
| 34 positive pole terminal | 36 set of two D size batteries |
| 38 negative wire | 40 negative pole terminal |
| 42 right switch terminal | 44 switch |
| 46 left switch terminal | 48 negative wire |
| 50 base cover | 52 rotatable container |
| 54 circular recesses | 56 napkins holder |
| 58 bulb cover | 60 bulb cover base |
| 62 hollow cone | 64 table I.D. tag |
| 66 label | 68 band with printed ad |
| 70 loop | |

SUMMARY

In accordance with the present invention a signaling device obviates the need of hand raising or calling out for service from a restaurant table or the like.

Description—FIGS. 1 to 10

Figure 1A:
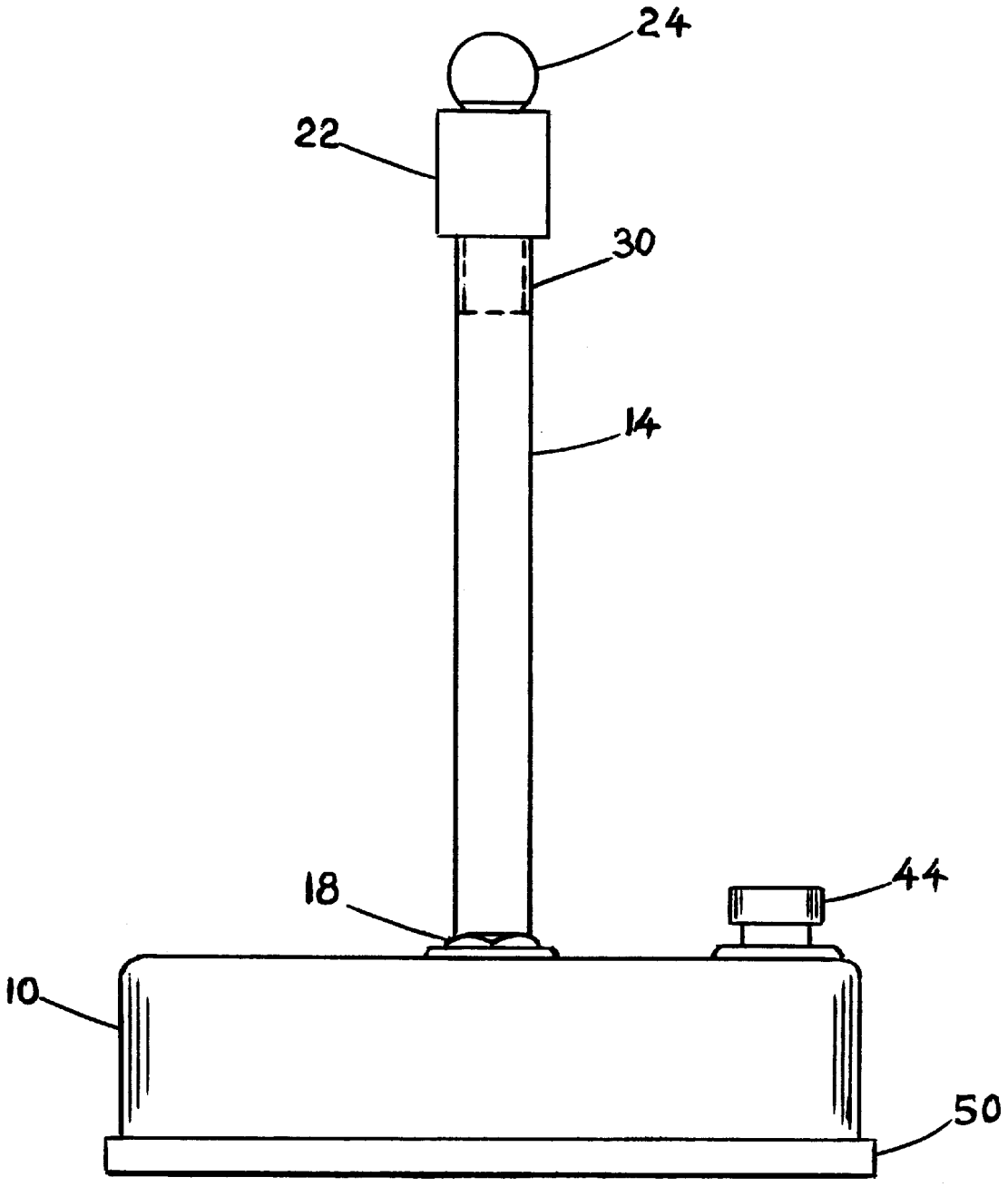
FIGS. 1A and 1B show various aspects of the signaling device exemplary embodiment, according to the present invention.
Figure 1B:
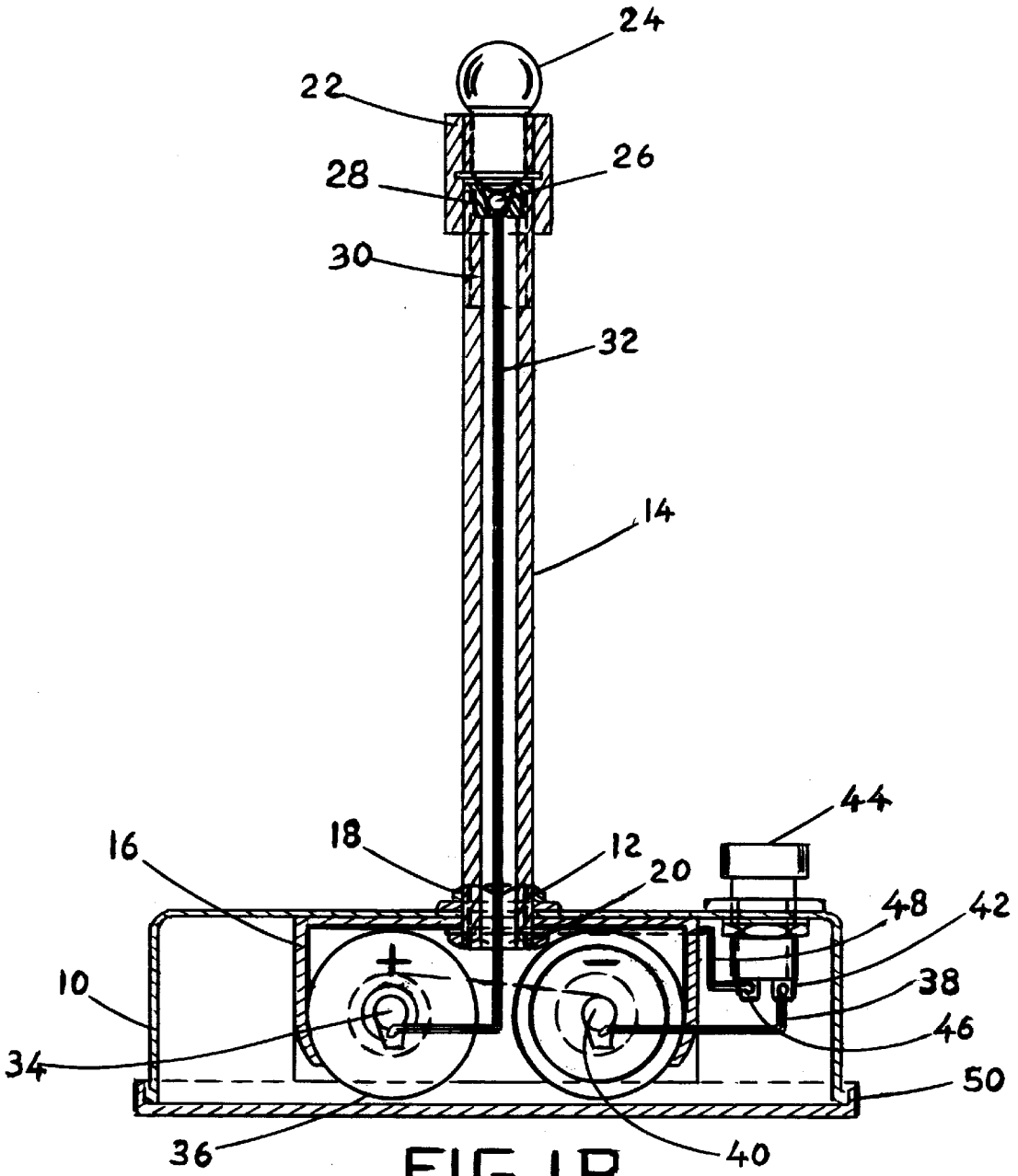
Figure 9:
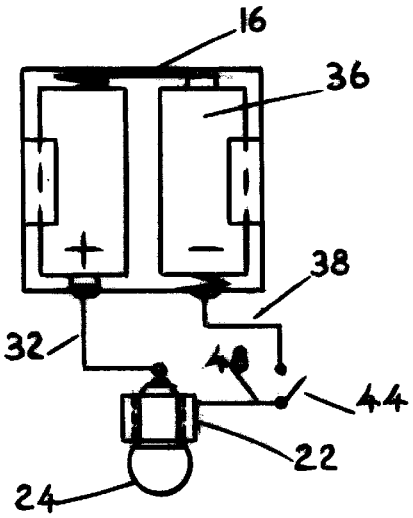
FIG. 9 shows the signaling device's electrical schematic representation.

A typical embodiment of the signaling device according to the present invention is illustrated in FIG. 1A (side view), FIG. 1B (side sectional view), and FIG. 9 (electrical schematic representation). The signaling device has a circular base 10 which houses a plastic batteries holder 16 and other electrical components hereinafter described.

The lower threaded end 12 of pipe 14 fits into the center hole of base 10 and plastic batteries holder 16 and is fastened to the base by palnut 18 and locknut 20 as shown in (FIG. 1B).

In the preferred embodiment the brass socket 22 is mounted on the upper threaded end 30 of pipe 14. Bulb 24 is also threaded into brass socket 22 with its positive terminal resting on the positive alloy contact 26 which sits on plastic bushing 28 inserted into pipe 14 at the upper threaded end 30. Positive alloy contact 26 is connected to the insulated positive wire 32 which runs into pipe 14 down to the positive pole terminal 34 of batteries holder 16. Negative wire 38 coming from negative pole terminal 40 of batteries holder 16 is connected to the right terminal 42 of switch 44 fastened to base 10 as shown in (FIGS. 1B and 9). Negative wire 48 goes from left switch terminal 46 to the pipe lower threaded end 12 fastened by locknut 20. Base cover 50 snaps fit into the bottom rolled edge of base 10 to conceal and protect the above described electrical components. Label 66 indicates how to call for service ("PRESS FOR SERVICE").

Figure 2:
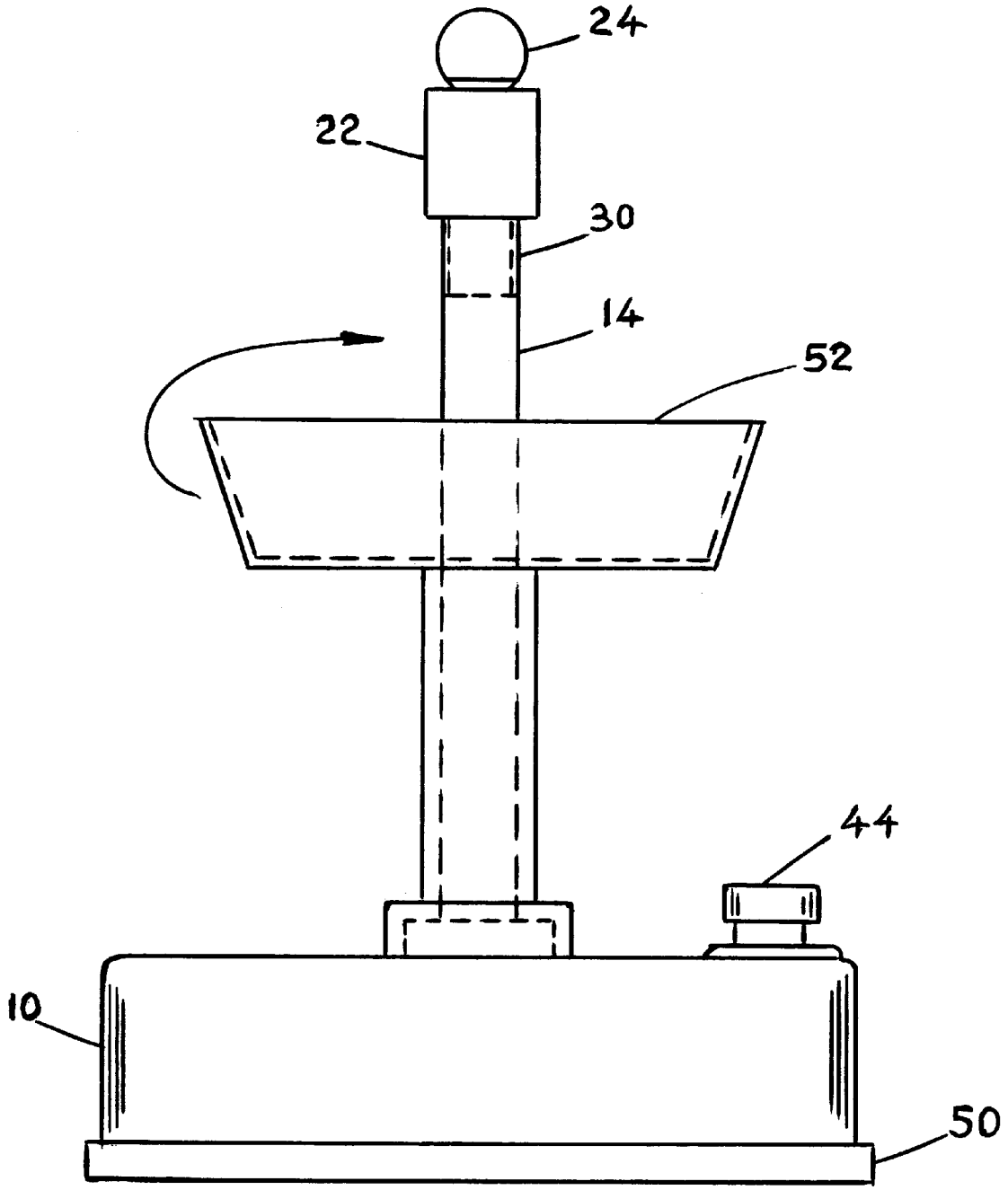
FIG. 2 shows a similar signaling device carrying a rotatable container for sugar, nutrasweet envelopes and other food seasoning.
Figure 3:
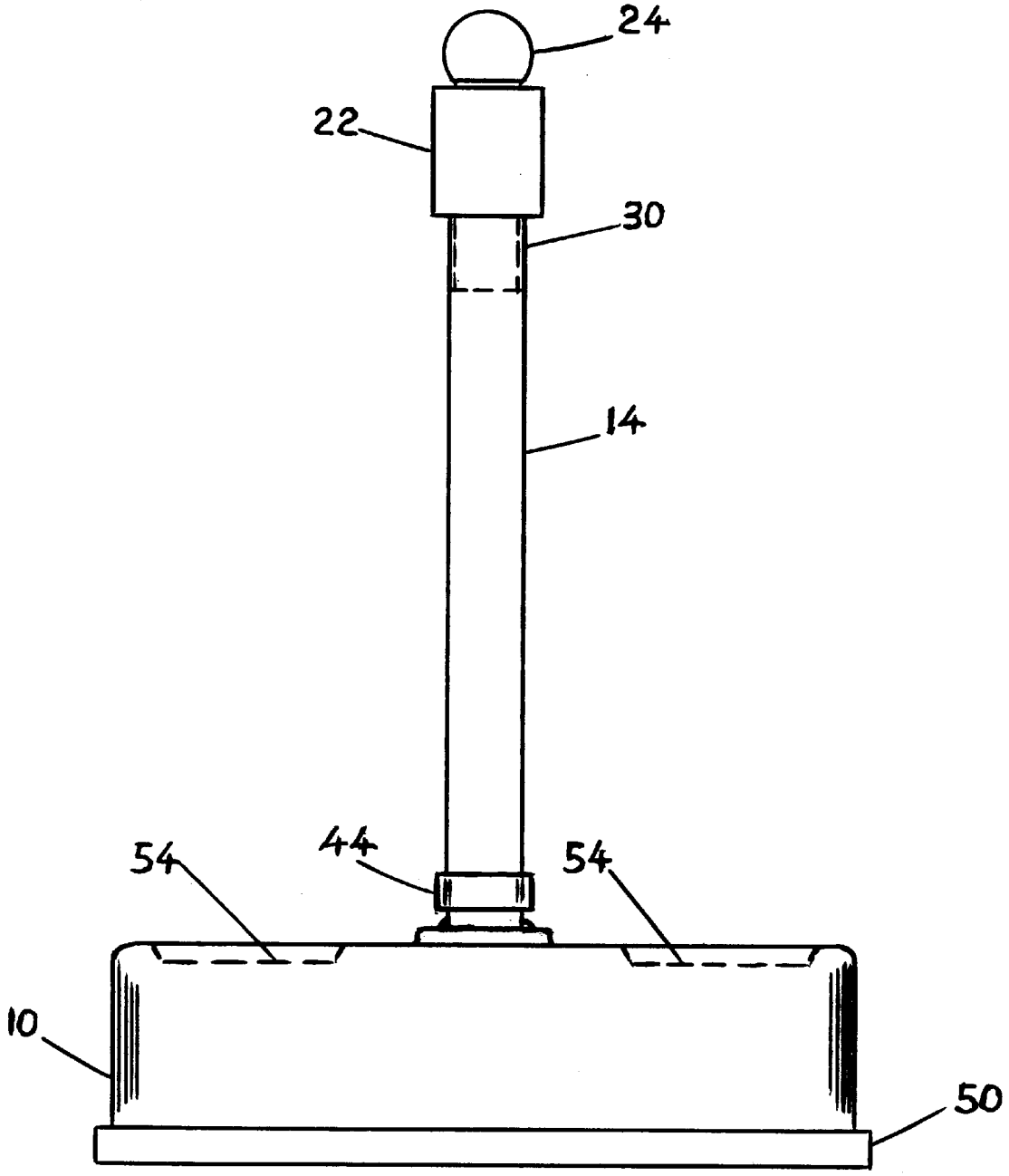
FIG. 3 shows a similar signaling device with two circular recesses marked in hidden lines, forming the base for positioning salt and pepper dispensers.
Figure 4:
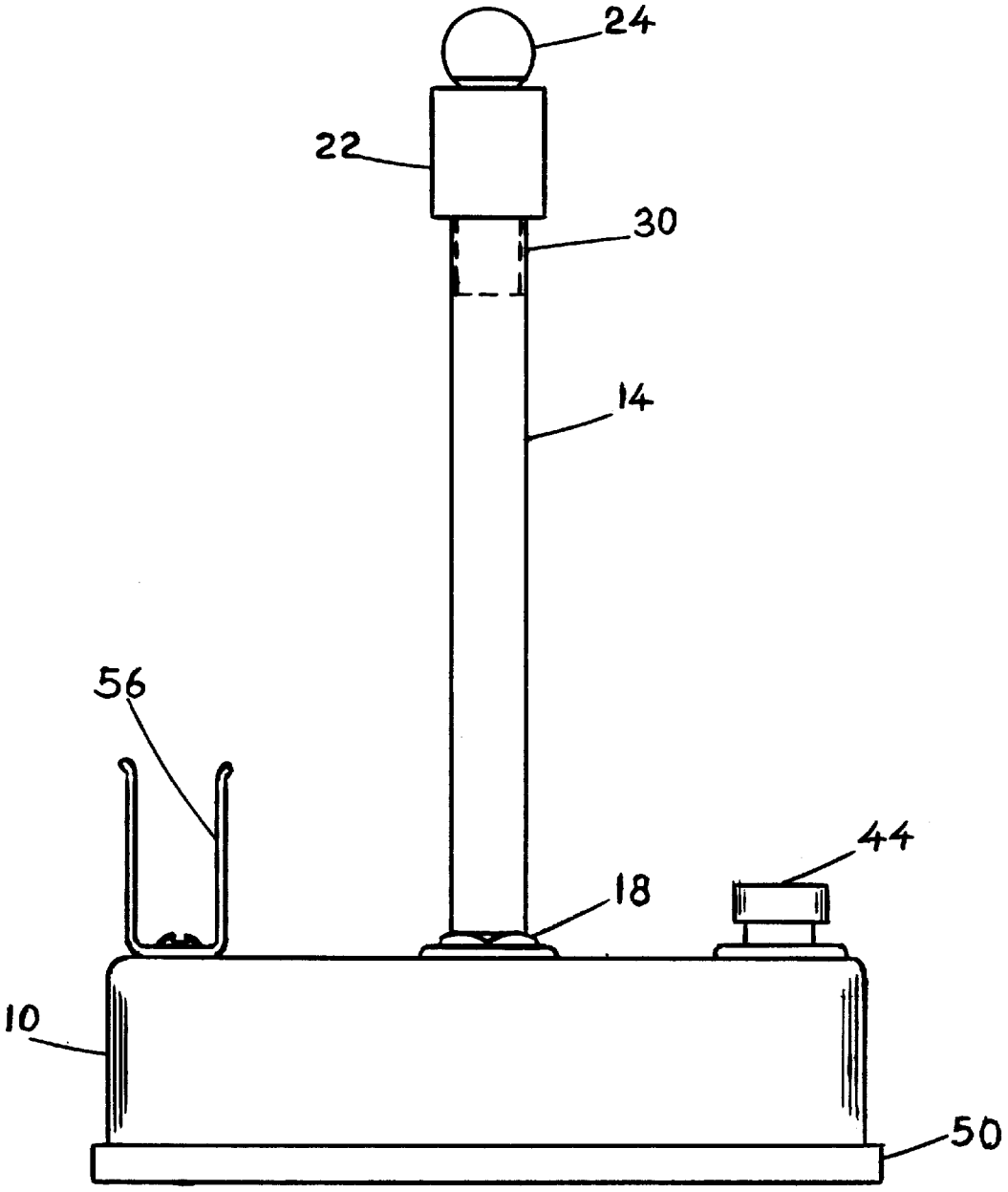
FIG. 4 shows a similar signaling device with a napkins holder fastened to the base.
Figure 10:
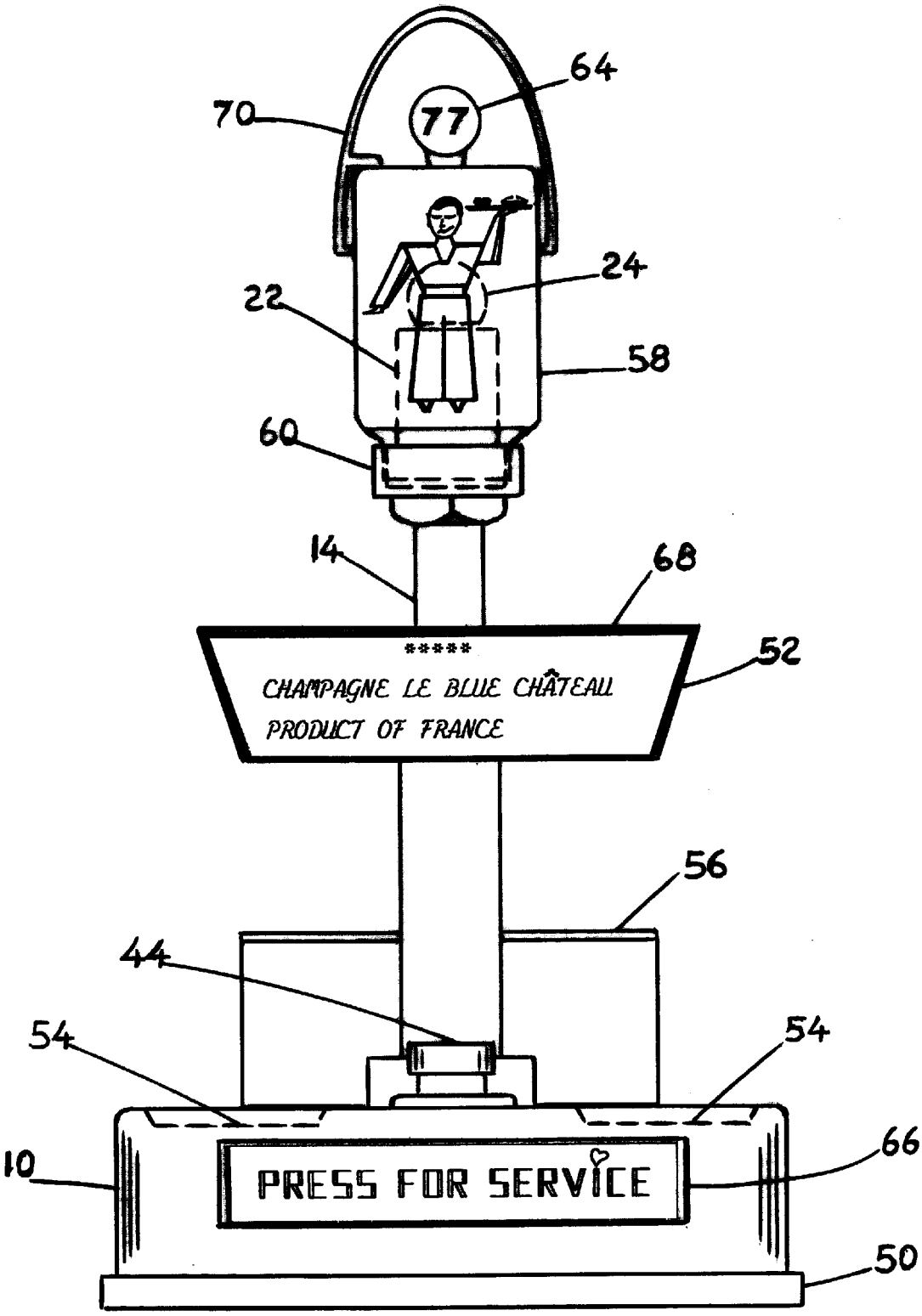
FIG. 10 shows the front view of the signaling device in its versatile configuration including the described accessories.

Additional embodiments are shown in FIGS. 2 through 10; in each case the signaling device is shown with one added accessory improving its versatility according to the present invention. In FIG. 2 the signaling device carries a hand rotatable container in which sugar, nutrasweet envelopes and/or other food seasoning can be conveniently placed; in FIG. 3 (as shown in hidden lines) two formed circular recesses are added to the base to locate salt and pepper dispensers. In FIG. 4 a napkins holder is also added to the base as shown; in FIG. 5 an opaque bulb cover, where an imprinted image of a waitress will be placed, is shown mounted on the bulb cover base; in FIG. 6 the bulb cover is shown with a hollow cone (in hidden lines) for the purpose of inserting a flower; in FIG. 7 a tag with its stalk inserted into the hollow cone of the bulb cover is shown for the purpose of identifying the table on which the signaling device is located; in FIG. 8 the bulb cover carries a loop for the easy handling of the above described centerpiece as shown in FIG. 10 with the added accessories.

There are various possibilities with regard to the relative disposition of the accessories incorporated in the signaling device illustrated in FIG. 10 which is also intended to obviate the need for additional space.

From the description above a number of advantages of my signaling means and method of calling for service become evident:

(a) The signaling device by incorporating all the above described accessories presently scattered on a restaurant table, will not require additional space.

(b) The signaling device with all the above described accessories assembled into a centerpiece not only obviates the need for additional space but will also obviate the need of hand raising or calling out for service from a restaurant table or the like.

(c) The signaling device will provide better and more efficient service.

(d) The signaling device will enable the waiter or waitress to quickly spot from a distance the table in need of service without continuosly asking the customer, considerably reducing waiting time.

(e) The signaling device will provide the establishment's manager with means to monitor the efficiency of the service.

(f) The signaling device will provide an increase in volume of food and beverage sales by expediting service and table availability.

Operation—FIGS. 1, 2, 3, 4, 5, 6, 7, 8, 9

The manner of using the signaling device to call for service is for the customer to simply turn ON the flashing light bulb by pressing switch 44 mounted on base 10 as shown in (FIGS. 1A through 10) of the exemplary embodiment of my above patent. Next the waiter or waitress will turn OFF said bulb 24 by pressing the switch as a method of responding to the call.

The manner of using the incorporated rotatable container 52 is to manually rotate the container free to turn around pipe 14 until the envelope of choice is at hand (side view FIG. 2).

The manner of using the formed circular recesses 54 shown in hidden lines on base 10 is to position the salt and pepper dispensers in each recess respectively (front view FIGS. 3 and 10).

The manner of using the napkins holder 56 mounted on base 10 is to insert the napkins between the holder blades (FIG. 4).

Figure 5:
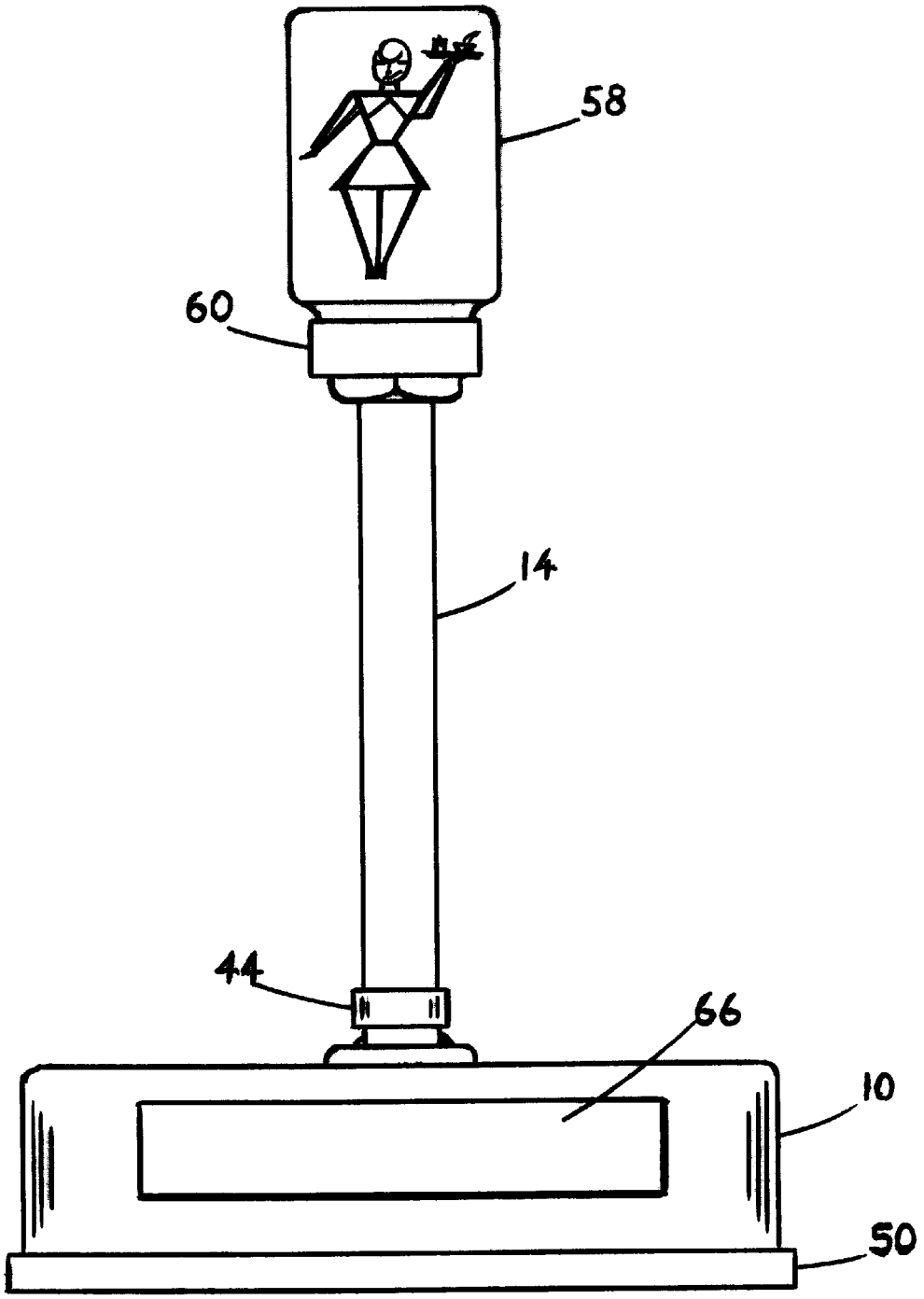
FIG. 5 shows the basic signaling device in a front view with an opaque bulb cover where the image of a waiter/waitress can be printed to characterize the invention.

The manner of making clearly visible the printed images of a waiter and/or a waitress, that could be placed on bulb cover 58, is by lighting bulb 24 (front view FIG. 5).

Figure 6:
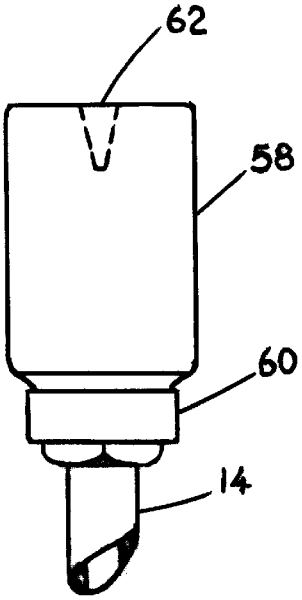
FIG. 6 shows the bulb cover of a similar signaling device with a hollow cone on top for the purpose of inserting a flower.

The manner of using bulb cover 58 as a flower holder is to insert the stem of the flower into the hollow cone 62 (FIG. 6).

Figure 7:
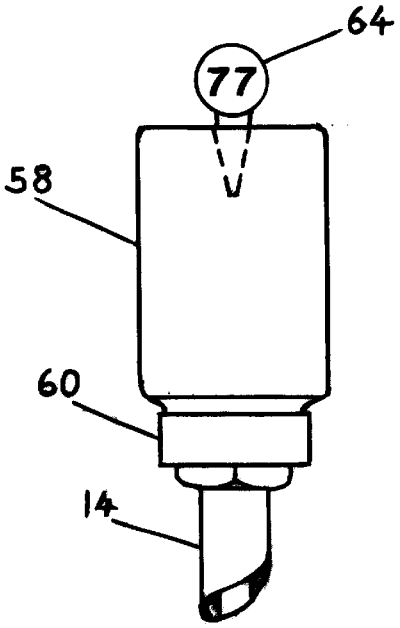
FIG. 7 shows the bulb cover of a similar signaling device with the stalk of a tag inserted into the hollow cone of the bulb cover to identify the table by a given number.

The manner of identifying a table is to place a sticker with a given number on top of bulb cover 58 or inserting the stalk of tag 64 into hollow cone 62 in lieu of the flower as shown in (FIG. 7).

Figure 8:
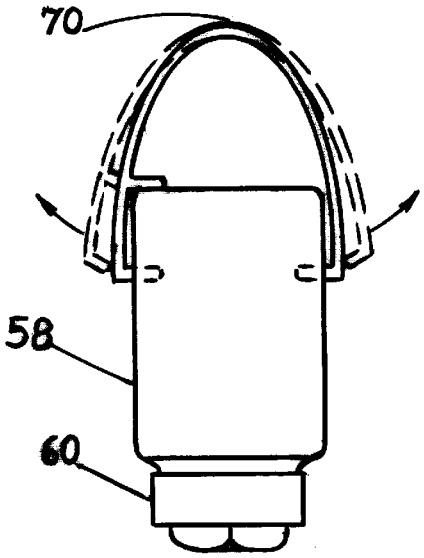
FIG. 8 shows the bulb cover illustrated on (FIG. 6) with a loop for easy handling of the signaling device.

The manner of installing loop 70 on bulb cover 58 is to slightly extend outwardly the two arms of the loop and let its pinned ends spring back into the side holes of the bulb cover as shown in (FIG. 8).

The manner of making visible the printed ad on band 68, is to install it inside and against the transparent inner vertical surface of container 52 as shown in the front view of (FIG. 10).

The manner of changing the batteries is to remove base cover 50 by pulling it out from the bottom rolled edge of base 10 and replace the batteries in the same positive and negative position as marked on the batteries holder 16 (FIGS. 1B and 9).

The manner of changing bulb 24 is to unscrew bulb cover 58 from bulb cover base 60 fastened to pipe 14 (FIG. 10), and unscrew bulb 24.

Conclusion, Ramifications, and Scope

Accordingly, the reader will see that the signaling means and method of calling for service pertaining to this invention can be used in lieu of a gesture or calling out for service, and as a versatile centerpiece that obviates the need of additional space, and has the additional advantages in that

- it enables the waiter or waitress to quickly spot from a distance the table in need of service;
- it will considerably reduce waiting time;
- it will expedite serving and therefore provide faster table availability increasing the sales of food and beverages;
- it will allow the establishment's manager to monitor the efficiency of the serving personnel;
- it will prevent the waiter or waitress to unnecessarily ask if service is needed by interrupting the customer who may be confidentially conversing with his guest.
- it will include the possibility of displaying an ad that by itself will pay for the cost of the centerpiece.
- it will enhance the style and type of service of the establishment that has it.

Although the description above contains many specificities, these should not be construed as limiting the scope of the invention but as merely providing illustrations of some of the presently preferred embodiments of this invention. For example the signaling device can have other base shapes, such as oval, square, trapezoidal, with a beer or pepsi container in lieu of pipe 14, any other decorative pedestal or objects as part of the centerpiece or any other alternative to the bulb emitting light, type of switch, bulb cover, etc.; the rotatable container can be replaced by one having a bigger base carrying all the above described accessories, while the switch can be mounted on the side of base 10.

Thus the scope of the invention should be determined by the appended claims and their legal equivalents, rather than by the examples given.

I claim:

1. A signaling device comprising a portable base containing a switch and a battery holder, said battery holder having batteries providing electrical means to a socket receiving a light bulb; said socket having been fastened to said base by a supporting means.

2. The signaling device of claim 1 wherein said light bulb activated by said switch illuminates a bulb cover carrying the image of a waiter or a waitress.

3. The signaling device of claim 1 wherein said bulb is a flashing bulb.

4. The signaling device of claim 1 wherein said device includes a container rotatable around the axis of said supporting means fastened to said base.

5. The signaling device of claim 4 wherein said container carries an imprinted commercial advertisement.

6. The signaling device of claim 1 comprising a tag to visually locate said device.

7. The signaling device of claim 1 wherein a napkins holder is fastened to said base.

8. The signaling device of claim 2 wherein said cover has a loop to facilitate the handling of said device.

* * * * *